US011840390B2

(12) United States Patent
Hosoya et al.

(10) Patent No.: US 11,840,390 B2
(45) Date of Patent: Dec. 12, 2023

(54) CONTAINER

(71) Applicant: SHARP KABUSHIKI KAISHA, Sakai (JP)

(72) Inventors: Naoki Hosoya, Sakai (JP); Kohhei Nanbu, Sakai (JP); Yuya Yano, Sakai (JP); Akira Ieyama, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/715,759

(22) Filed: Apr. 7, 2022

(65) Prior Publication Data

US 2022/0340352 A1 Oct. 27, 2022

Related U.S. Application Data

(60) Provisional application No. 63/180,640, filed on Apr. 27, 2021.

(51) Int. Cl.
*B65D 81/05* (2006.01)
*B65D 85/48* (2006.01)

(52) U.S. Cl.
CPC ..... *B65D 81/054* (2013.01); *B65D 85/48* (2013.01); *B65D 2581/055* (2013.01); *B65D 2585/6837* (2013.01)

(58) Field of Classification Search
CPC .... B65D 25/10; B65D 25/101; B65D 25/107; B65D 81/054; B65D 85/48; B65D 2585/6837
USPC ..... 206/449, 586, 453, 454
See application file for complete search history.

(56) References Cited

U.S. PATENT DOCUMENTS

| | | | | |
|---|---|---|---|---|
| 8,083,063 | B2 * | 12/2011 | Lu | H01L 21/67373 206/454 |
| 9,365,318 | B2 * | 6/2016 | Yue | B65D 25/10 |
| 2016/0001964 | A1 * | 1/2016 | Yue | B65D 85/48 206/555 |
| 2019/0300261 | A1 * | 10/2019 | Nakamichi | B65D 85/30 |
| 2020/0172315 | A1 * | 6/2020 | Hu | B65D 81/113 |
| 2020/0198867 | A1 * | 6/2020 | Nakamichi | H01L 21/67369 |
| 2021/0163205 | A1 | 6/2021 | Nakamichi | |

FOREIGN PATENT DOCUMENTS

| | | | |
|---|---|---|---|
| JP | 2014009020 | A | 1/2014 |
| WO | 2018/211667 | A1 | 11/2018 |

* cited by examiner

*Primary Examiner* — Steven A. Reynolds
(74) *Attorney, Agent, or Firm* — ScienBiziP, P.C.

(57) ABSTRACT

A container includes: a storage member having a bottom-surface member and a side-surface member; and two protectors disposed at two corners adjacent to each other, the two corners belonging to four corners of a storage space. Each of the two protectors has a support portion detachably fitted in a corresponding one of two cuts, a first reception portion having a first reception surface facing an end surface of a housed object, and a second reception portion having a second reception surface facing an end surface of the housed object. The first and/or second reception portion is integral with the support portion. The second reception portion has, in at least a part adjacent to a bottom surface, an evacuation portion in which a distance between the second reception surface and a side surface of the side-surface member facing the second reception surface increases along with approach to the bottom surface.

14 Claims, 8 Drawing Sheets

CONTAINER

CROSS-REFERENCE TO RELATED APPLICATION

The present application claims priority from Provisional Application No. 63/180,640, the content to which is hereby incorporated by reference into this application.

BACKGROUND

1. Field

The disclosure relates to containers, and for instance, to a container that is suitably used in transporting plate-shaped housed objects susceptible to breakage.

2. Description of the Related Art

Japanese Unexamined Patent Application Publication No. 2014-9020 for instance discloses a packing material (i.e., a container) that is used in transporting display panels. The container in Japanese Unexamined Patent Application Publication No. 2014-9020 has a corner protector at a corner of a recess that houses the display panels. The corner protector is fitted in the container's body detachably and protects the corners of the display panels, which are housed objects. Japanese Unexamined Patent Application Publication No. 2014-9020 describes that using the corner protector enables a common container body and a common container lid to be used in both housing a display panel with a circuit board connected thereto (hereinafter, also referred to as a display panel module) and housing only a display panel.

Unfortunately, using the container described in Japanese Unexamined Patent Application Publication No. 2014-9020 possibly causes the display panel to break in some cases. Such panel breakage occurs due to the corner edge of the display panel snagged on the corner protector when the display panel (or display panel module) is taken out of the container. Alternatively, to avoid such panel breakage, the efficiency of panel takeout lowers in some cases. For instance, robot-based automatization is a difficult problem.

International Publication No. 2018/211667 discloses a container that can prevent a break or a work efficiency reduction during taking out a housed object.

The container described in International Publication No. 2018/211667 is configured such that a protector disposed at a corner of a recess that houses display panels has an inner component having a reception surface being in contact with the display panels, and an outer component disposed between the inner component and container' body, and such that with the outer component removed, at least a part of the inner component can evacuate into a space where the outer component has been located. Accordingly, removing the outer component firstly when taking out the display panel produces a space around the corner of the display panel, thereby avoiding the display panel from breakage.

SUMMARY

Unfortunately, the reception surface of the protector described in International Publication No. 2018/211667 has a 90° angle with respect to the container's bottom surface, and hence the size (distance between reception surfaces facing each other) of the space portion in which the corner of the display panel is located) housing the display panel is constant from the container's top (opening) to the container's bottom; if the display panel is slanted, the corner of the display panel gets snagged on the reception surface in some cases (see FIG. 6 for instance, which will be described later on). This possibly causes the display panel to break from the corner snagged on the reception surface. Avoiding this problem requires careful and accurate work, and unfortunately, this reduces work efficiency or involves difficulty in robot-based automatization.

If the number of housed display panels is small with respect to the container's storage space, an excess space is produced within the container (an unnecessary space remains). Even if a buffer material for the display panels, such as a buffer sheet, is filled in the excess space, the display panels possibly bound due to sway during transport, and the display panels possibly get snagged on the reception surface at their corners while remaining tilted.

A known container for transporting mass-produced goods is designed to house a predetermined number of display panels (ten or more display panels for instance) and has a small size margin. Hence, housing fewer display panels than the predetermined number of display panels tends to cause the foregoing problem. Furthermore, separately preparing a container that houses a small number of display panels increases costs. Moreover, the need for transporting a few display panels, including technical samples and user return goods for defectiveness analysis, occurs randomly. These display panels each have their technical meanings and must be hence avoided from breakage during transport more strongly than mass-produced goods.

It is thus an aspect of the disclosure to provide a container that is less likely to break a housed object even when the container houses fewer housed objects than a predetermined number of housed objects. Although the foregoing has described a display panel as a housed object by way of example, the housed object is, for instance, a four-sided (i.e., rectangular) plate-shaped housed object having corners that are all right angles.

An aspect of the disclosure provides solutions to the problem listed below

Item 1

A container including:

a storage member having a bottom-surface member defining a bottom surface of a storage space having four corners, and a side-surface member defining side surfaces of the storage space, the bottom-surface member defining an x-y plane, the side-surface member defining an x-z plane and a y-z plane both orthogonal to the x-y plane; and two protectors disposed at two corners adjacent to each other in an x-direction, the two corners belonging to the four corners of the storage space, wherein the side-surface member has, at the two corners, two cuts facing the storage space, each of the two protectors has a support portion detachably fitted, in a z-direction, in a corresponding one of the two cuts, a first reception portion having a first reception surface facing an end surface in the x-direction of a housed object that is to be housed in the storage space, and a second reception portion having a second reception surface facing an end surface in a y-direction of the housed object, the first reception portion and/or the second reception portion is integral with the support portion, and the second reception portion has, in at least a part adjacent to the bottom surface, an evacuation portion in which a distance between the second reception surface and a side surface of the side-surface member facing the second reception surface increases along with approach to the bottom surface. Here, x, y, and z constitutes a rectangular coordinate system.

Item 2

The container according to Item 1, wherein the evacuation portion includes a portion that is the closest to the bottom surface in the second reception surface.

Item 3

The container according to Item 1 or 2, wherein the second reception portion constitutes the evacuation portion all across the second reception surface.

Item 4

The container according to any one of Items 1 to 3, wherein in the evacuation portion, the second reception surface is tilted toward an inside of the storage space at an angle of less than 90° with respect to the bottom surface.

Item 5

The container according to any one of Items 1 to 3, wherein the second reception surface has a curved surface in the evacuation portion.

Item 6

The container according to any one of Items 1 to 5, wherein the first reception portion is integral with the support portion, and the second reception portion is configured to be detachably fitted in the first reception portion.

Item 7

The container according to any one of Items 1 to 5, wherein the second reception portion has an outer member having the second reception surface and a filling space, and a filler detachably inserted in the filling space.

Item 8

The container according to Item 7, wherein the second reception portion is configured such that the distance at an end adjacent to an opening of the container, with the filler not inserted in the filling space is larger than the distance with the filler inserted in the filling space.

Item 9

The container according to Item 7 or 8, wherein the second reception portion is configured such that the distance with the filler not inserted in the filling space increases along with distance from the bottom surface.

Item 10

The container according to any one of Items 1 to 8, wherein the first reception portion has, in at least a part adjacent to the bottom surface, another evacuation portion in which a distance between the first reception surface and a side surface of the side-surface member facing the first reception surface increases along with approach to the bottom surface.

Item 11

The container according to any one of Items 1 to 10, further including a protective sheet disposed on each of the first reception surface and the second reception surface.

Item 12

The container according to any one of Items 1 to 11, wherein the storage member is made of a foamed plastic.

Item 13

The container according to any one of Items 1 to 12, wherein the two protectors are made of a non-foamed plastic. The protective sheet according to item 11 is made of a harder non-foamed plastic than the two protectors.

An aspect of the disclosure provides a container that is less likely to break a housed object (for instance, a rectangular plate-shaped housed object) even when the container houses fewer housed objects than a predetermined number of housed objects.

DETAILED DESCRIPTION

With reference to the drawings, the following describes a container according to an aspect of the disclosure as well as how to use the container. The container according to an aspect of the disclosure is not limited to what is described by way of example below. Although a display panel is herein illustrated as a housed object by way of example, the housed object may be a rectangular plate-shaped housed object for instance.

Figure 1:
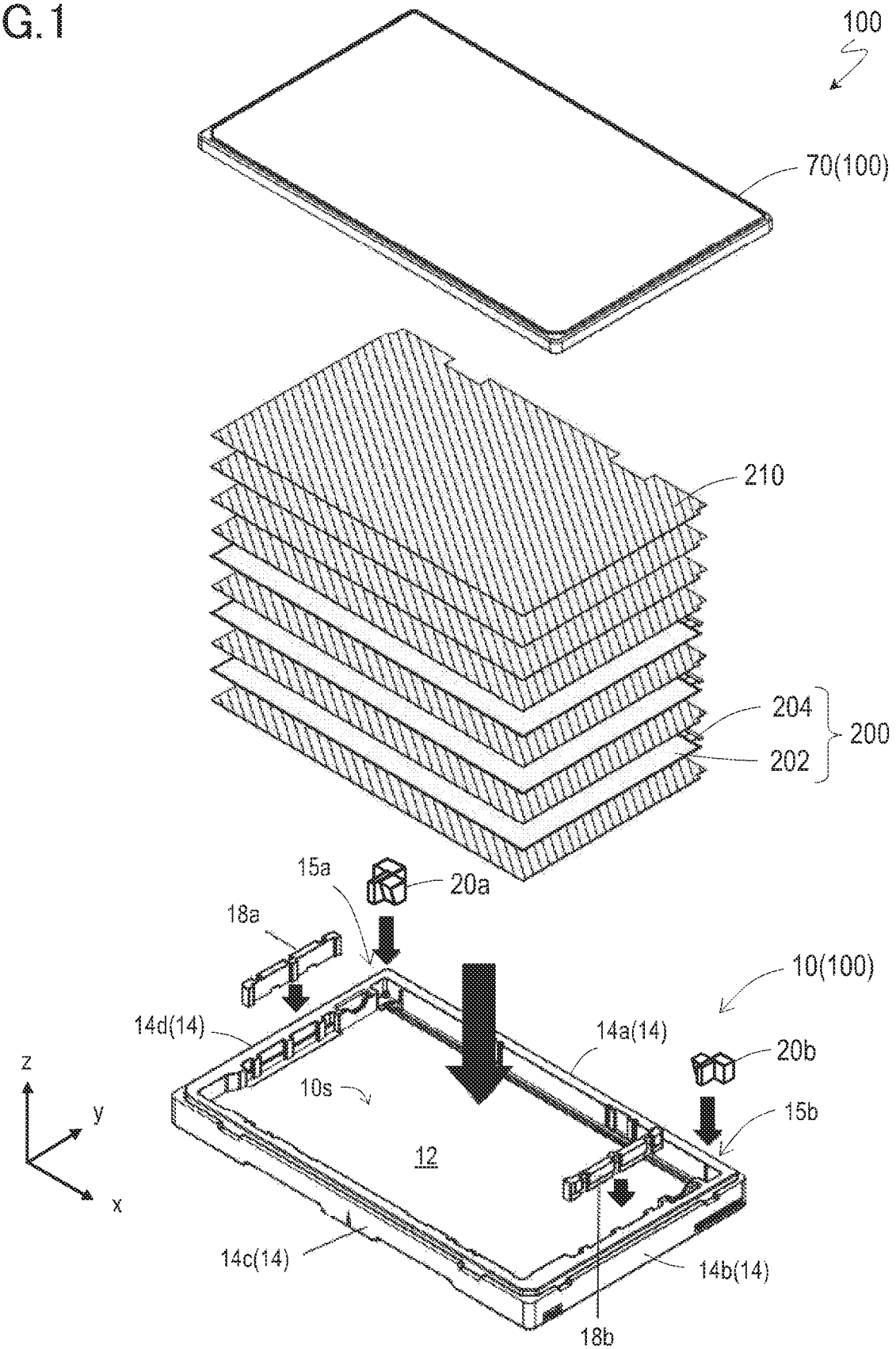
FIG. 1 is a schematic exploded perspective view of a container 100 according to an aspect of the disclosure and illustrates display panel modules 200 as well as buffer sheets 210 both of which are to be housed.
Figure 2:
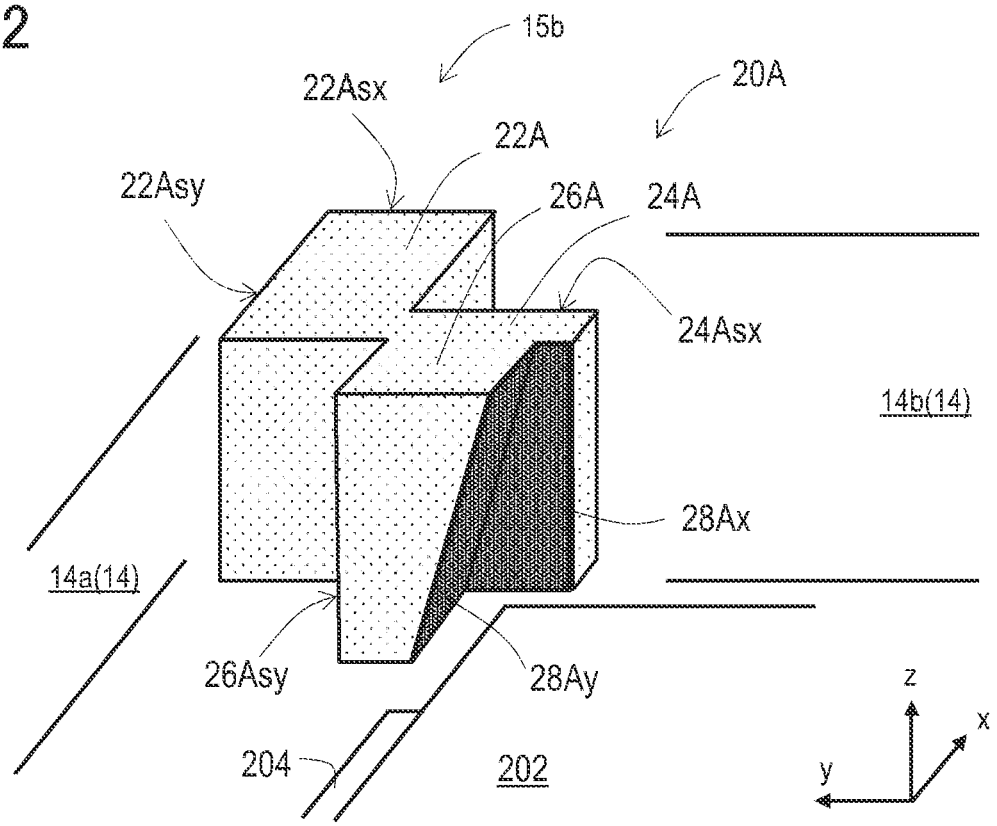
FIG. 2 is a schematic perspective view of a protector 20A, which can be included in the container 100.
Figure 3:
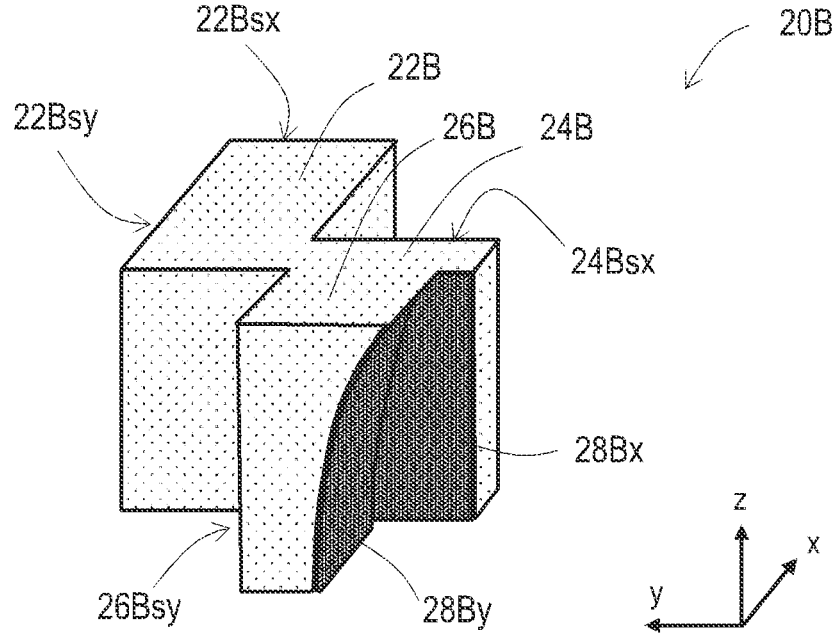
FIG. 3 is a schematic perspective view of a protector 20B, which can be included in the container 100.

With reference to FIG. 1 to FIG. 3, the structure of a container 100 according to an aspect of the disclosure will be described firstly, and then with reference to FIG. 4 to FIG. 6, advantages of the container 100 will be described in comparison with a container 900 in a comparative example having a protector 90*a*, illustrated in FIG. 6.

FIG. 1 is a schematic exploded perspective view of the container 100 according to an aspect of the disclosure and illustrates display panel modules 200 as well as buffer sheets 210 both of which are to be housed.

The container 100 has a storage member 10, protectors 20*a* and 20*b*, and a lid 70, which is optional. When containers 100 are stacked for use, the bottom of the storage member 10 of the upper container 100 can be used as a lid. The storage member 10 and the lid 70 are made of a foamed plastic for instance, and the protectors 20*a* and 20*b* are made of a non-foamed plastic.

The storage member 10 has a bottom-surface member 12 defining the bottom surface of a storage space 10*s* having four corners, and a side-surface member 14 defining the side surfaces of the storage space 10*s*. The side-surface member 14 consists of side-surface members 14*a*. 14*b*, 14*c*, and 14*d* integral together. The side-surface members 14*a*, 14*b*, 14*c*, and 14*d* define the four side surfaces of the storage space 10*s*. The bottom-surface member 12 defines an x-y plane, and the side-surface member 14 defines an x-z plane and a y-z plane both orthogonal to the x-y plane. Here, x, y, and z constitute a rectangular coordinate system. Although the container 100 that is substantially rectangular herein is illustrated with the length of the storage space 10*s* in an x-direction being larger than the length of the storage space 10*s* in a y-direction in conformance with the shape of the display panel modules 200, which are housed objects, this shape is non-limiting.

The protectors 20*a* and 20*b* are disposed at two of the four corners of the storage space 10*s* adjacent to each other in the x-direction. The side-surface member 14 has, at the two corners, two cuts 15*a* and 15*b* facing the storage space, and each of the two protectors 20*a* and 20*b* is detachably fitted, in a z-direction, in a corresponding one of the two cuts 15*a* and 15*b*. Each display panel module 200 has a display panel 202 having, for instance, a glass substrate and has a circuit board 204 mounted on the display panel 202. The protectors 20*a* and 20*b* allocate a gap so that the circuit board 204, protruding outward from one of the longer sides of the display panel 202, is kept from contact with the side-surface member 14*a*, thus protecting the circuit board 204.

The side-surface members 14*b* and 14*d* may have panel-side attachments 18*a*, and 18*b*, which are optional. The panel-side attachments 18*a* and 18*b* are attached as necessary when, for instance, display panels having different outer-shape sizes are housed. The panel-side attachments 18*a* and 18*b* are made of, for instance, the same foamed plastic as the storage member 10 and lid 70. Herein, although the panel-side attachments 18*a* and 18*b* for conformance with a size change in the x-direction are illustrated by way of example, a panel-side attachment can be provided that is attached to the side-surface members 14*a* and 14*c* in order to conform with a size change in the y-direction. It is noted that recesses and other things disposed in the side-surface member 14, which are provided for a weight reduction in the side-surface member 14 and/or material savings and are well known in the field of plastic processing, will be omitted from description.

When a circuit board is mounted on the other longer side of the display panel 202, a protector may be disposed at the other two corners of the storage space 10*s*. When a circuit board is mounted on either shorter side, a protector may be disposed at a corner including the shorter side of the storage space 10*s*; alternatively, when a circuit board is mounted on the two shorter sides, a protector may be disposed at the other two corners as well.

The display panel module 200 is placed in the storage space 10*s* while sandwiched between the buffer sheets 210. When fewer display panel modules 200 than a predetermined capacity of the container 100 are housed at this time, a plurality of buffer sheets 210 are filled for instance, as illustrated in FIG. 1, so that no extra space is left in the storage space 10*s*. However, how many packing buffer materials, such as the buffer sheets 210, are to be filled in such an extra space possibly differs between workers or other persons, and in some cases, such buffer materials are not filled enough to prevent the display panel modules 200 from bounds resulting from sway during transport.

FIG. 2 and FIG. 3 illustrate examples of the protectors 20*a* and 20*b*. The protectors 20*a* and 20*b* may be symmetric with respect to the y-z plane, and thus the following describes the structure and function of a protector used as the protector 20*b*.

FIG. 2 is a schematic perspective of a protector 20A, which can be included in the container 100. The protector 20A has the following: a support portion 22A detachably fitted in the corresponding cut 15*b* in the z-direction; a first reception portion 24A having a first reception surface facing an end surface in the x-direction of a housed object that is to be housed in the storage space 10*s*; and a second reception portion 26A having a second reception surface facing an end surface in the y-direction of the housed object.

The support portion 22A is inserted into the cut 15*b* in such a manner that a surface 22Asx of the support portion 22A faces a side surface of a side-surface member 14*b* inside the cut 15*b*, and that a surface 22Asy of the support portion 22A faces a side surface of a side-surface member 14*a* inside the cut 15*b*. At this time, a surface 24Asx of the first reception portion 24A faces a side surface of the side-surface member 14*b* (outside the cut 15*a*), and a surface 26Asy of the second reception portion 26A faces a side surface of the side-surface member 14*a* (outside the cut 15*a*). Here, the surfaces of the protector 20A and side-surface member 14 facing each other may be in contact with each other. Here, a subscript sx, as in the surface 22Asx and the surface 24Asx for instance, denotes a surface perpendicular to the x-direction (parallel to the y-z plane), and a subscript sy, as in the surface 22Asy and the surface 26Asy for instance, denotes a surface perpendicular to the y-direction (parallel to the z-x plane).

The protector 20A further has protective sheets 28Ax and 28Ay respectively disposed on the first reception surface and second reception surface. The protective sheets 28Ax and 28Ay are made of, for instance, a harder non-foamed plastic than the protector 20A and avoid the first and second reception surfaces of the protector 20A from damage resulting from contact with the glass substrate of the display panel 202. The protective sheets 28Ax and 20Ay can be omitted. In the following, the first reception surface will be denoted by the same reference sign as the protective sheet 28Ax, and the second reception surface will be denoted by the same reference sign as the protective sheet 28Ay.

Figure 4:
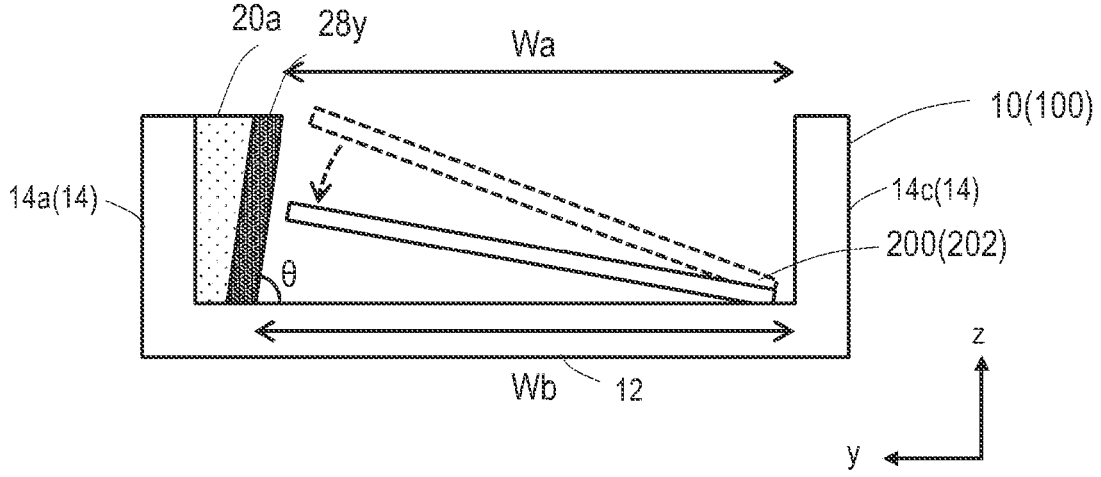
FIG. 4 is a schematic sectional view of how the display panel modules 200 are housed in the container 100.
Figure 5:
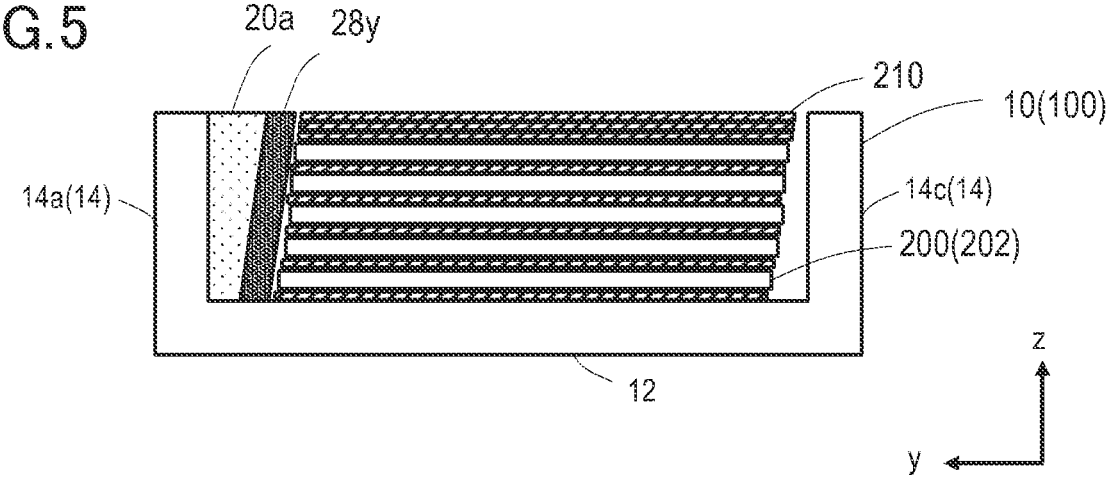
FIG. 5 is a schematic sectional view of how the display panel modules 200 and the buffer sheets 210 are housed in the container 100.

The first reception portion 24A and/or the second reception portion 26A is integral with the support portion 22, and the second reception portion 26A is configured such that the distance between the second reception surface 28Ay and a side surface of the side-surface member 14*c* facing the second reception surface 28Ay increases along with approach to the bottom surface (see FIGS. 4 and 5 for instance). The second reception surface 28Ay of the protector 20A is tilted toward the inside of the storage space 10*s* at an angle (θ in FIG. 4) of less than 90° with respect to the bottom surface, which is defined by the bottom-surface member 12.

The second reception surface needs to be configured such that its distance to and from a side surface of the side-surface member facing the second reception surface increases along with approach to the bottom surface. Like the second reception surface 28Ay of the protector 20A, the second reception surface does not need to consist, in whole, of a surface tilted at an angle of less than 90° respect to the bottom surface, defined by the bottom-surface member 12; the second reception portion needs to have a tilted surface in its part adjacent to the bottom surface (for instance, the half or less of the height of the storage space 10*s*, which is the length in the z-direction). The part of the second reception portion in which the distance between the second reception surface and the side surface of the side-surface member facing the second reception surface increases along with approach to the bottom surface offers an additional space to the display panel module 200, and this part will be thus referred to as an "evacuation portion" (for instance, see an evacuation portion 26Ca in FIG. 7, which will be described later on, and an evacuation portion 26Da in FIG. 8, which will be described later on).

FIG. 3 is a schematic perspective of a protector 20B, which can be included in the container 100. The protector 20B has a support portion 22B, a first reception portion 24B, and a second reception portion 26B. The support portion 22B is inserted into the cut 15*b*, and a surface 22Bsx and a surface 22Bsy face side surfaces of the side-surface member 14 inside the cut 15*b*. At this time, a surface 24Bsx of the first reception portion 24B faces a side surface of the side-surface member 14*b* (outside the cut 15*b*), and a surface 26Bsy of the second reception portion 26B faces a side surface of the side-surface member 14*a* (outside the cut 15*b*). The protector 20B further has protective sheets 28Bx and 28By respectively disposed on a first reception surface 28Bx and a second reception surface 28By.

The protector 20B has substantially the same structure as the protector 20A with the exception that the second reception surface 28By has a curved surface. Such a curved surface may be provided in a configuration where the distance between the second reception surface 28By and a side surface of the side-surface member 14*c* facing the second reception surface 28By increases along with approach to the bottom surface. The curved surface includes, for instance, a portion in which its tangent forms an angle of less than 90° with respect to the bottom surface.

Like the second reception surface 28By of the protector 20B, the reception surface does not need to be a curved surface in whole; the second reception portion needs to have a curved surface close to the bottom surface. Nevertheless, in the considerable vicinity of the bottom surface including where the curved surface (or tilted surface) is in contact with the bottom surface, the second reception portion may include a straight portion perpendicular to the bottom surface rather than a strictly curved surface (or tilted surface), when it is smaller than the degree of thickness of the display panel.

Figure 6:
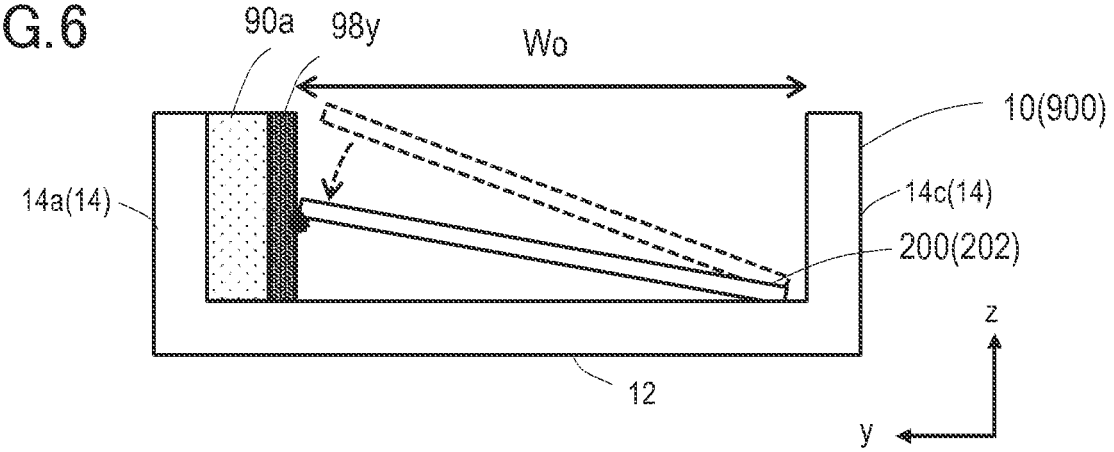
FIG. 6 is a schematic sectional view of how the display panel modules 200 are housed in a container 900 in a comparative example having a protector 90*a;*

With reference to FIG. 4 to FIG. 6, advantages of the container 100 will be described. FIG. 4 is a schematic sectional view of how the display panel modules 200 are housed in the container 100, and FIG. 5 is a schematic sectional view of how the display panel modules 200 and the buffer sheets 210 are housed in the container 100. FIG. 4 and FIG. 5 illustrate, in a sectional view, parallel to the y-z plane, a portion including the second reception surface 28*y* of the protector 20*a*. FIG. 6 is a schematic sectional view of how the display panel modules 200 are housed in the container 900 in the comparative example having the protector 90*a*. The protector 90*a* has a reception surface 98*y* perpendicular to the bottom surface. FIG. 6 illustrates, in a sectional view, parallel to the y-z plane, a portion including the second reception surface 98*y* of the protector 90*a* of the container 900.

With reference to FIG. 6, the following describes a problem that occurs at the time of housing the display panel modules 200 into the container 900 in the comparative example. The container 900 is different from the container 100 in that it has the protector 90*a* having the reception surface 98*y* perpendicular to the bottom surface, and the container 900 has the same storage member 10 as the container 100.

The size of a space of the container 900 where the display panels 202 are housed (to be strict, the size of a rectangle defined by the positions of the four corners of each display panel 202), that is, the distance between the reception surface 98*y* and a side surface of the side-surface member 14*c* is constant from the top (opening) of the container 900 to the bottom of the container 900, as illustrated in FIG. 6, and will be referred to as a width Wo. The width Wo is set to be larger than the length (width) of the shorter sides of the display panel 202. The width Wo measures 101 to 102% inclusive of a width Wp of the display panel 202 for instance. Reducing the gap between the container 900 and display panel 202 (the difference between the width Wo and width Wp) can reduce an impact that is exerted on the side surfaces of the container 900 during transport.

If the display panel 202 is slanted at the time of housing the display panel module 200 into the container 900, the lower edge of a corner of the display panel 202 (a corner of the glass substrate for instance) gets snagged on the reception surface 98*y* in some cases, as illustrated in FIG. 6. In addition to the forgoing, when the display panel 202 housed properly parallel to the bottom surface, which is defined by the bottom-surface member 12 of the container 900, bounds up and falls down to its original position due to sways during transport for instance, a deviation in the y-direction occurs, thus causing the lower edge of a corner of the display panel 202 to get snagged on the reception surface 98*y* in some cases, as illustrated in FIG. 6. If the lower edge of a corner of the display panel 202 gets snagged on the reception surface 98*y* like this, a large stress is exerted on the snagged location, thus breaking the display panel 202 (the glass substrate for instance) at this location in some cases.

In contrast to this, the second reception surface 28*y* of the protector 20*a* of the container 100 is tilted at an angle θ of less than 90° with respect to the bottom surface, defined by the bottom-surface member 12, and thus the distance to and from a side surface of the side-surface member 14*c* facing the second reception surface 28*y* increases along with approach to the bottom surface, as illustrated in FIG. 4. That is, the second reception surface 28*y* has a width Wa at the top (opening) of the container 100 and has a width Wb (<Wa) at the bottom surface of the container 100. The width Wa measures 101 to 102% inclusive of the width Wp of the display panel 202 for instance. The width Wb measures 101 to 110% inclusive of the width Wa for instance. The tilt angle θ of the second reception surface 28*y* needs to be set in such a manner that the width Wb and the width Wa satisfy the aforementioned relationship. For instance, let the depth of the container 100 (the length of the storage space 10*s* in the z-direction) measure about 100 mm, and let the width Wp of the display panel 202 measure 250 mm; accordingly, the tilt angle θ measures 78 to 85° inclusive. Using such a configuration prevents a corner edge of the display panel 202 from getting snagged on the reception surface 28*y* even if the display panel 202 is slanted, as seen from FIG. 4.

The second reception surface can achieve the forgoing effect even when it is a curved surface like the second reception surface 2813*y* of the protector 20B, which is illustrated in FIG. 3. The shape of such a curved surface is not limited to what has been described as an example; the curved surface needs to have such a shape that the distance to and from a side surface of the side-surface member 14*c* facing the second reception surface 28By increases along with approach to the bottom surface.

The second reception surface needs to be configured such that its distance to and from a side surface of the side-surface member facing the second reception surface increases along with approach to the bottom surface, and the second reception surface does not need to consist, in whole, of a surface tilted at an angle θ of less than 90° with respect to the bottom surface, which is defined by the bottom-surface member 12, like the second reception surface 28*y* illustrated here. In particular, to prevent breakage that occurs during housing of fewer display panel modules than a predetermined number of display panel modules, the distance between the second reception surface and a side surface of the side-surface member facing the second reception surface may be configured to increase along with approach of a part of the second reception surface adjacent to the bottom surface to the bottom surface. When an evacuation portion is provided in only a part adjacent to the bottom surface, the evacuation portion is provided to, for instance, include a portion that is the closest to the bottom surface in the second reception surface.

As described above, the container according to an aspect of the disclosure, which includes the protector having, in at least a part adjacent to the bottom surface, a portion (evacuation portion) in which the distance between the second reception surface and a side surface of the side-surface member facing the second reception surface increases along with approach to the bottom surface, can prevent the edge of a display panel from getting snagged on the second reception surface due to bound-up of the display panel module resulting from sway during transport when fewer display panel modules than a predetermined number of display panel modules are housed. As illustrated in FIG. 4 and FIG. 5, a configuration where the entire second reception surface is tilted, which provides a smaller area where the end of the display panel is in contact with the second reception surface than a configuration where the second reception surface is perpendicular, can prevent the edge of the display panel form getting snagged on the second reception surface at the time of inserting the display panel module. This configuration can also prevent the second reception surface from getting snagged on the edge of the display panel at the time of taking the protector firstly in order to take out the display panel module.

Figure 7:
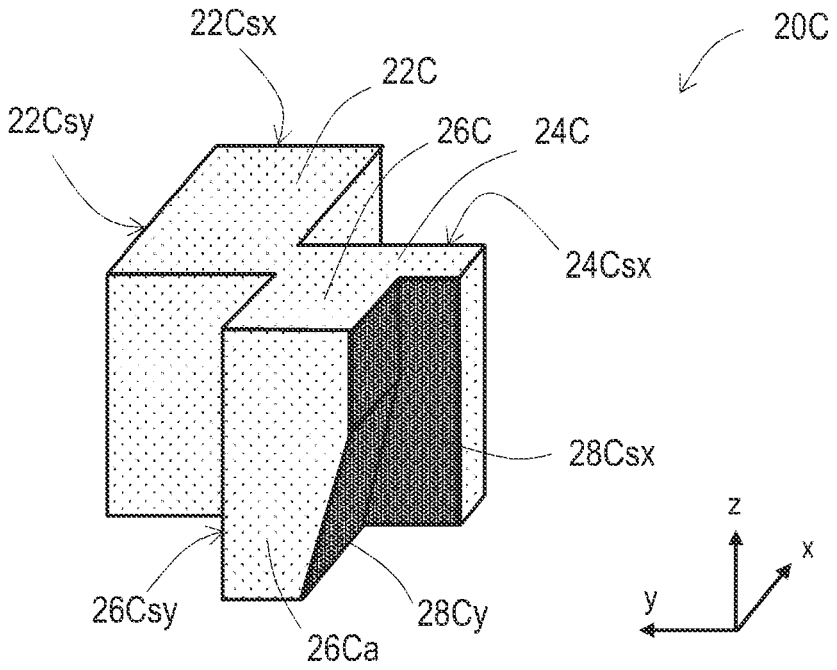
FIG. 7 is a schematic perspective view of a protector 20C, which can be included in the container according to an aspect of the disclosure.

FIG. 7 is a schematic perspective view of a protector 20C, which can be included in the container according to an aspect of the disclosure. The protector 20C has a support portion 22C, a first reception portion 24C, and a second reception portion 26C. The support portion 22C is inserted into the cut 15*b*, and a surface 22Csx and a surface 22Csy face side surfaces of the side-surface member 14 inside the cut 15*b*. At this time, a surface 24Csx of the first reception portion 24C faces a side surface of the side-surface member 14*b* (outside the cut 15*b*), and a surface 26Csy of the second reception portion 26C faces a side surface of the side-surface member 14*a* (outside the cut 15*b*). The protector 20C further has protective sheets 28Cx and 28Cy respectively disposed on a first reception surface 28Cx and a second reception surface 28Cy.

The protector 20C has, in only a part adjacent to the bottom surface, the evacuation portion 26Ca configured such that the distance to and from a side surface of the side-surface member 14*c* facing the second reception surface 28Cy increases along with approach to the bottom surface. The evacuation portion 26Ca includes a portion that is the closest to the bottom surface in the second reception surface 28Cy. That is, only a part of the second reception surface 28Cy adjacent to the bottom surface is tilted toward the inside of the storage space 10*s* at an angle θ of less than 90° with respect to the bottom surface. The evacuation portion 26Ca can be formed to include a half or less of the height (length in the z-direction) of the storage space 10*s*, as illustrated. The length of the evacuation portion 26Ca in the z-direction needs to be set in accordance with the length of the display panel module 200 in the v-direction and other things, by reflecting a height at which a corner of the display panel 202 possibly gets snagged on the second reception surface 28Cy (for instance, a height at which the display panel 202 possibly bounds up due to sway during transport). In the protector 20A, shown in FIG. 2, and the protector 20B, shown in FIG. 3, both the second reception portions 26A and 26B have their evacuation portions disposed all across the second reception surface 28Ay or 28By.

Here, instead of such a tilted surface of the evacuation portion 26Ca of the second reception portion 26C, a curved surface may be provided. The curved surface includes, for instance, a portion in which its tangent forms an angle of less than 90° with respect to the bottom surface.

Like the second reception surface 28By of the protector 20B, the reception surface does not need to be a curved surface in whole; the second reception portion needs to have a curved surface close to the bottom surface. Nevertheless, in the considerable vicinity of the bottom surface including where the curved surface (or tilted surface) is in contact with the bottom surface, the second reception portion may include a straight portion perpendicular to the bottom surface rather than a strictly curved surface (or tilted surface), when it is smaller than the degree of thickness of the display panel.

Figure 8:
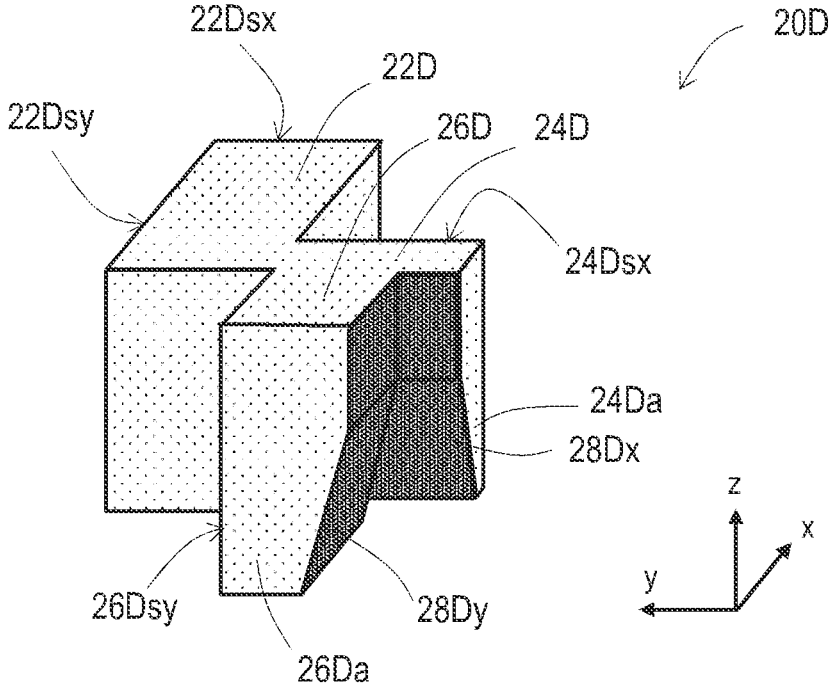
FIG. 8 is a schematic perspective view of a protector 20D, which can be included in the container according to an aspect of the disclosure.

FIG. 8 is a schematic perspective view of a protector 20D, which can be included in the container according to an aspect of the disclosure. The protector 20D has a support portion 22D, a first reception portion 24D, and a second reception portion 261. The support portion 22D is inserted into the cut 15*b*, and a surface 22Dsx and a surface 22Dsy face side surfaces of the side-surface member 14 inside the cut 15*b*. At this time, a surface 24Dsx of the first reception portion 24D faces a side surface of the side-surface member 14*b* (outside the cut 15*b*), and a surface 26Dsy of the second reception portion 26D faces a side surface of the side-surface member 14*a* (outside the cut 15*b*). The protector 20D further has protective sheets 28Dx and 28Dy respectively disposed on a first reception surface 28Dx and a second reception surface 28Dy.

Like the second reception portion 26C of the protector 20C, the second reception portion 26D of the protector 20D has, in only a part adjacent to the bottom surface, the evacuation portion 26Da configured such that the distance to and from a side surface of the side-surface member 14*c* facing the second reception surface 28Dy increases along with approach to the bottom surface. The evacuation portion 26Da includes a portion that is the closest to the bottom surface in the second reception surface 28Dy. That is, only a part of the second reception surface 28Dy adjacent to the bottom surface is tilted toward the inside of the storage space 10*s* at an angle θ of less than 90° with respect to the bottom surface. The first reception portion 24D of the protector 201) further has, in only a part adjacent to the bottom surface, another evacuation portion, 24Da, in which the distance between the first reception surface 28Dx and a side surface of a side-surface member 14*d* facing the first reception surface 28Dx increases along with approach to the bottom surface. The evacuation portion 24Da includes a portion that is the closest to the bottom surface in the second reception surface 28Dx. That is, only a part of the first reception surface 28Dx adjacent to the bottom surface is tilted toward the inside of the storage space 10*s* at an angle θ of less than 90° with respect to the bottom surface. Here, the tilt angle θ of the first reception surface 28Dx can be set independently of the tilt angle θ of the second reception surface 28Dy within approximately the same range as the tilt angle θ of the second reception surface 28Dy. As a matter of course, the first reception surface 28Dx may be a titled surface in whole or may be a curved surface instead of a tilted surface.

Figure 9A:
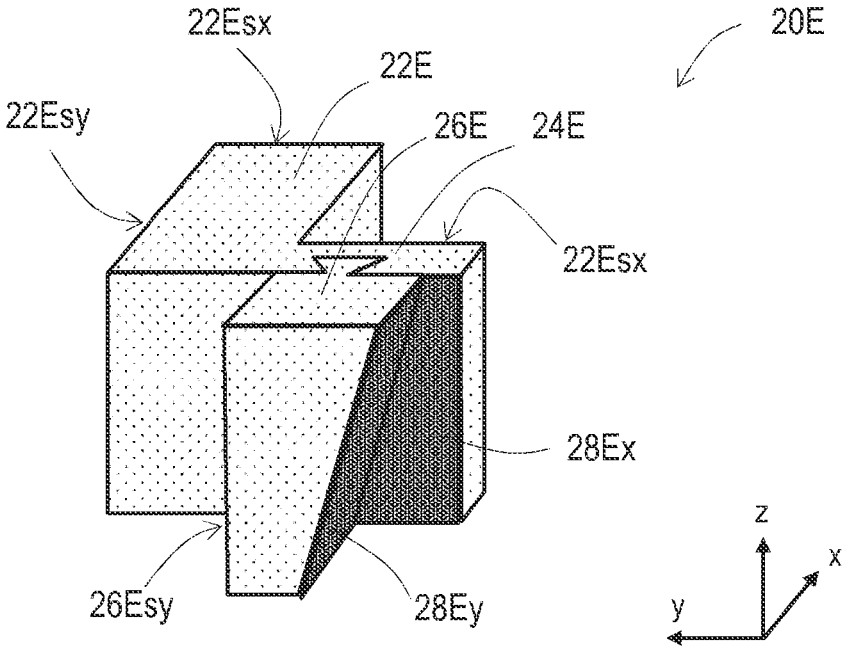
FIG. 9A is a schematic perspective view of a protector 20E, which can be included in the container according to an aspect of the disclosure.
Figure 9B:
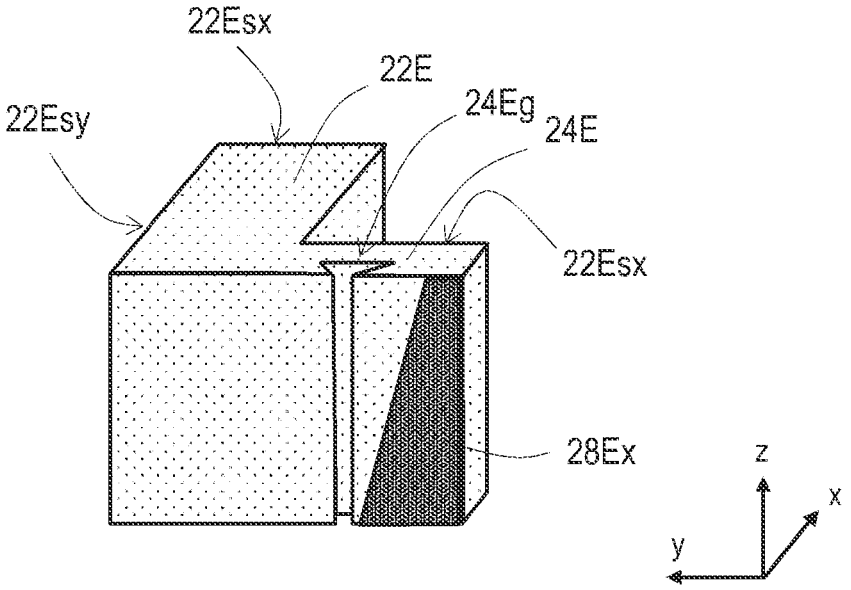
FIG. 9B is a schematic perspective view of a support portion 22E and a first reception portion 24E of the protector 20E.
Figure 9C:
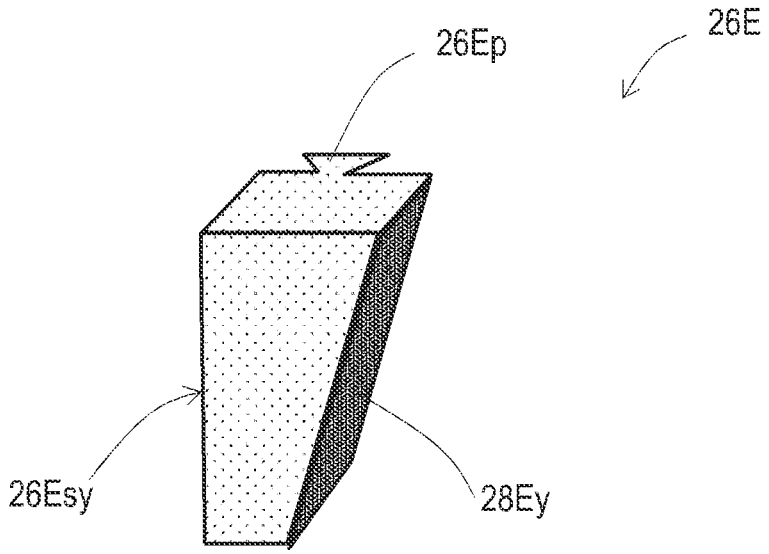
FIG. 9C is a schematic perspective view of a second reception portion 26E of the protector 20E.
Figure 9D:
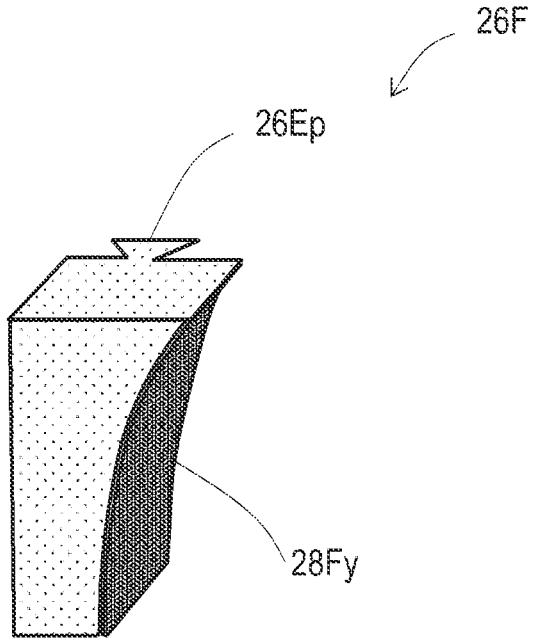
FIG. 9D is a schematic perspective view of a second reception portion 26F, which can be used instead of the second reception portion 26E.

With reference to FIG. 9A to FIG. 9D, the following describes the structure and function of a protector 20E, which can be included in the container according to an aspect of the disclosure. FIG. 9A is a schematic perspective view of the protector 20E. FIG. 9B is a schematic perspective view of a support portion 22E and a first reception portion 24E of the protector 20E, and FIG. 9C is a schematic perspective view of a second reception portion 26E of the protector 20E. FIG. 9D is a schematic perspective view of a second reception portion 26F, which can be used instead of the second reception portion 26E.

FIG. 9A schematically illustrates the protector 20E in a perspective view. The protector 20E has the support portion 22E, the first reception portion 24E, and the second reception portion 26E. The support portion 22E is inserted into the cut 15*b*, and a surface 22Esx and a surface 22Esy face side surfaces of the side-surface member 14 inside the cut 15*b*. At this time, a surface 24Esx of the first reception portion 24E faces a side surface of the side-surface member 14*b* (outside the cut 15*b*), and a surface 26Esy of the second reception portion 26E faces a side surface of the side-surface member 14*a* (outside the cut 15*b*). The protector 20E further has protective sheets 28Ex and 28Ey respectively disposed on a first reception surface 28Ex and a second reception surface 28Ey. The protector 20E has substantially the same structure as the protector 20A, shown in FIG. 2, with the exception that the first reception portion 24E is integral with the support portion 22E, and that the second reception portion 26E is configured to be detachably fitted in the first reception portion 24E.

As illustrated in FIG. 9B, the first reception portion 24E of the protector 20E has a groove 24Eg extending in the z-direction, and as illustrated in FIG. 9C, the second reception portion 26E has a protrusion 26Ep extending in the z-direction. Inserting the protrusion 26Ep into the groove 24Eg brings the first reception portion 24E and second reception portion 26E into fitted in each other. The shapes of the groove 24Eg and protrusion 26Ep in a section perpendicular to the z-direction are not limited to a trapezoidal shape like the illustrated one, but they preferably have such a shape as not to become detached in the x-direction. That is, a portion in which a length in the y-direction becomes larger in the x-direction is preferably provided.

Instead of the second reception portion 26E, the second reception portion 26F shown in FIG. 9D can be used for instance. The second reception portion 26F has a second reception surface 28Fy that is a curved surface. Accordingly, combination with the first reception portion 24E, shown in FIG. 9B, can form a protector having substantially the same structure as the protector 20B, shown in FIG. 3. As a matter of course, a protective sheet 28Ex, when provided, needs to change shape as appropriate.

The configuration where the second reception portion is detachably fitted in the first reception portion is not limited to the foregoing examples; for instance, the configuration is applicable also to the protector 20C, shown in FIG. 7, and the protector 20D, shown in FIG. 8, and various modifications can be devised. Using such a configuration can efficiently produce a protector having a second reception portion of various shapes. That is, merely replacing the second reception portion alone can Obtain the protectors 20A, 20B, and 20C. In addition to this, taking out only the second reception portion firstly, when taking out the display panel module enables the display panel module to be taken out easily.

Figure 10A:
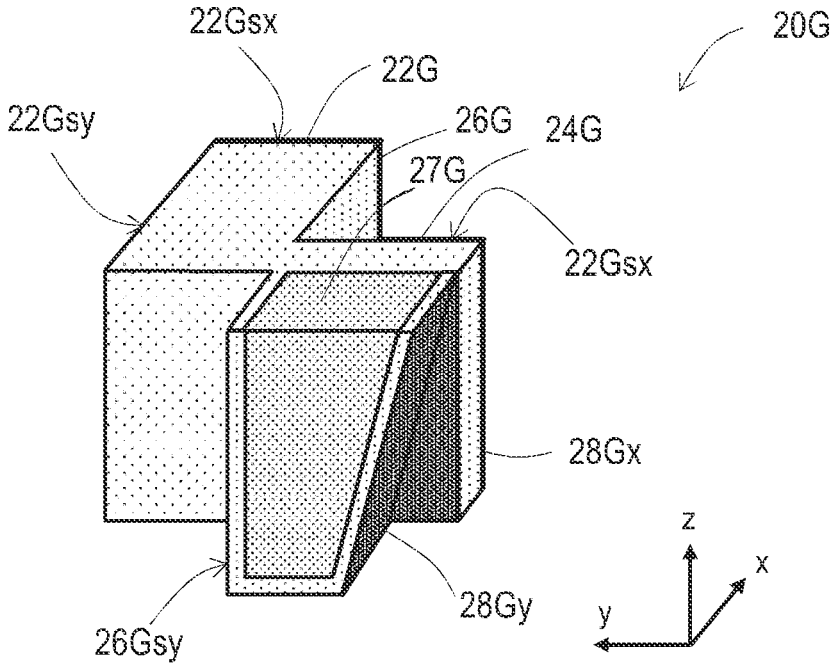
FIG. 10A is a schematic perspective view of a protector 20G, which can be included in the container according to an aspect of the disclosure.
Figure 10B:
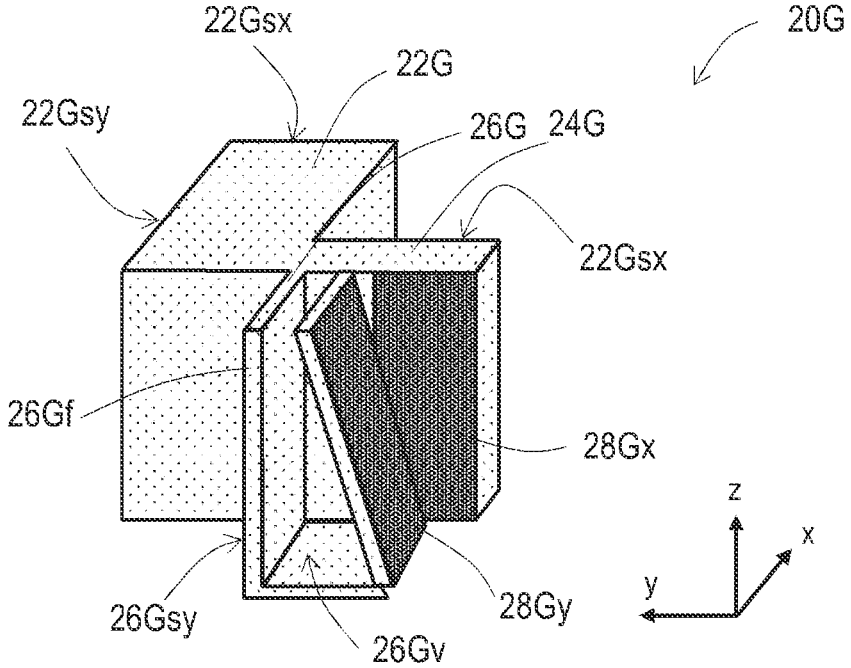
FIG. 10B is a schematic perspective view of the protector 20G with a filler 27G removed from a second reception portion 26G.
Figure 10C:
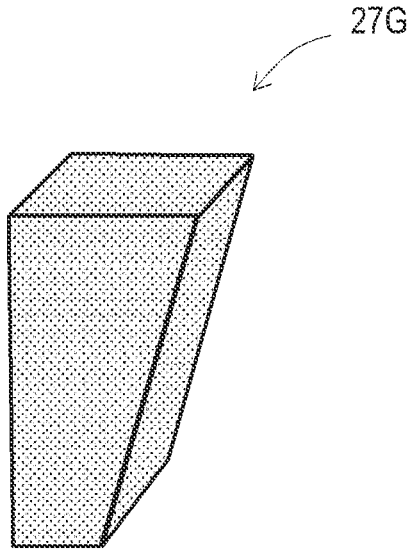
FIG. 10C is a schematic perspective view of the filler 27G of the protector 20G.

With reference to FIG. 10A to FIG. 10C, the following describes the structure and function of a protector 20G, which can be included in the container according to an aspect of the disclosure. FIG. 10A is a schematic perspective view of the protector 20G. FIG. 10B is a schematic perspective view of the protector 20G with a filler 27G removed from a second reception portion 26G, and FIG. 10C is a schematic perspective view of the filler 27G of the protector 20G.

FIG. 10A schematically illustrates the protector 20G in a perspective view. The protector 20G has a support portion 22G, a first reception portion 24G, and the second reception portion 26G. The support portion 22G is inserted into the cut 15*b*, and a surface 22Gsx and a surface 22Gsy face side surfaces of the side-surface member 14 inside the cut 15*b*. At this time, a surface 24Gsx of the first reception portion 24G faces a side surface of the side-surface member 14*b* (outside the cut 15*b*), and a surface 26Gsy of the second reception portion 26G faces a side surface of the side-surface member 14*a* (outside the cut 15*b*). The protector 20G further has protective sheets 28Gx and 28Gy respectively disposed on a first reception surface 28Gx and a second reception surface 28Gy.

As illustrated in FIG. 10B, the second reception portion 26G has an outer member 26Gf having the second reception surface 28Gy and a filling space 26Gv. The outer member 26Gf is integral with the first reception portion 24G. The filler 27G shown in FIG. 10C is detachably inserted into the filling space 26Gv. With the filler 27G inserted in the filling space 26Gv, the second reception portion 26G of the protector 20G is configured, as illustrated in FIG. 10A, such that the distance to and from a side surface of the side-surface member 14*c* facing the second reception surface 28Gy increases along with approach to the bottom surface.

With the filler 27G not inserted in the filling space 26Gv by contrast, the second reception portion 26G of the protector 20G is configured, as illustrated in FIG. 10B, such that the distance to and from the side surface of the side-surface member 14*c* facing the second reception surface 28Gy, at an end adjacent to the opening of the container is larger than the distance with the filler 27G inserted in the filling space 26Gv. The second reception portion 26G of the protector 20G is also configured such that the distance between the second reception surface 28Gy and the side surface of the side-surface member 14*c* facing the second reception surface 28Gy increases along with distance from the bottom surface. That is, the second reception surface 28Gy is configured to form an angle of more than 90° with respect to the bottom surface. Accordingly, taking out only the filler firstly, when taking out the display panel module enables the display panel module to be taken out easily. Here, the outer member 26Gf is made of an elastic material, and thus attaching and detaching the filler 27G to and from the filling space 26G can reversibly change the angle of the second reception surface 28Gy with respect to the bottom surface.

The container according to an aspect of the disclosure is formed by using the following materials for instance. The storage member is made of a foamed plastic (for instance, EPS or expanded polystyrene). The protectors are made of a non-foamed plastic (for instance, HDPE or high-density polyethylene). The protective sheets are made of a harder non-foamed plastic (PC or polycarbonate) than the protectors.

The container according to an aspect of the disclosure is less likely to break a housed object even when it contains fewer housed objects (for instance, rectangular plate-shaped housed objects) than a predetermined number of housed objects. The container according to an aspect of the disclosure is suitably used in, but not limited to, transporting display panel modules each having a glass substrate.

While there have been described what are at present considered to be certain embodiments of the disclosure, it will be understood that various modifications may be made thereto, and it is intended that the appended claim cover all such modifications as fall within the true spirit and scope of the disclosure.

What is claimed is:

1. A container comprising:

a storage member having a bottom-surface member defining a bottom surface of a storage space having four corners, and a side-surface member defining side surfaces of the storage space, the bottom-surface member defining an x-y plane, the side-surface member defining an x-z plane and a y-z plane both orthogonal to the x-y plane; and two protectors disposed at two corners adjacent to each other in an x-direction, the two corners belonging to the four corners of the storage space, wherein the side-surface member has, at the two corners, two cuts facing the storage space, each of the two protectors has a support portion detachably fitted, in a z-direction, in a corresponding one of the two cuts, a first reception portion having a first reception surface facing an end surface in the x-direction of a housed object that is to be housed in the storage space, and a second reception portion having a second reception surface facing an end surface in a y-direction of the housed object, the first reception portion and/or the second reception portion is integral with the support portion, the second reception portion has, in at least a part adjacent to the bottom surface, an evacuation portion in which a distance between the second reception surface and a facing surface increases along with approach to the bottom surface, the facing surface facing the second reception surface, being perpendicular to the bottom surface, and being in a same position in a y-direction from a side adjacent to the bottom surface to a side adjacent to an opening of the container, and a y-direction range in which the housed object is to be disposed in the storage space is defined by the second reception surface and the facing surface.

2. The container according to claim 1, wherein the evacuation portion includes a portion that is the closest to the bottom surface in the second reception surface.

3. The container according to claim 1, wherein the second reception portion comprises the evacuation portion all across the second reception surface.

4. The container according to claim 1, wherein in the evacuation portion, the second reception surface is tilted toward an inside of the storage space at an angle of less than 90° with respect to the bottom surface.

5. The container according to claim 1, wherein the second reception surface has a curved surface in the evacuation portion.

6. The container according to claim 1, wherein the first reception portion is integral with the support portion, and the second reception portion is configured to be detachably fitted in the first reception portion.

7. The container according to claim 1, wherein the second reception portion has an outer member having the second reception surface and a filling space, and a filler detachably inserted in the filling space.

8. The container according to claim 7, wherein the second reception portion is configured such that the distance at an end adjacent to an opening of the container, with the filler not inserted in the filling space is larger than the distance with the filler inserted in the filling space.

9. The container according to claim 7, wherein the second reception portion is configured such that the distance with the filler not inserted in the filling space increases along with distance from the bottom surface.

10. The container according to claim 1, wherein the first reception portion has, in at least a part adjacent to the bottom surface, another evacuation portion in which a distance between the first reception surface and a side surface of the side-surface member facing the first reception surface increases along with approach to the bottom surface.

11. The container according to claim 1, further comprising a protective sheet disposed on each of the first reception surface and the second reception surface.

12. The container according to claim 1, wherein the storage member is made of a foamed plastic.

13. The container according to claim 1, wherein the two protectors are made of a non-foamed plastic.

14. The container according to claim 1, wherein the facing surface is a side surface of the side-surface member facing the second reception surface.

* * * * *